US005328406A

United States Patent [19]

Morris, Jr. et al.

[11] Patent Number: 5,328,406

[45] Date of Patent: Jul. 12, 1994

[54] FASCIA VENTILATOR AND DRIP EDGE

[76] Inventors: John S. Morris, Jr., 524 Cass St., Monroe, Mich. 48161; Hayse Keeling, 24344 Ecorse Rd., Taylor, Mich. 48180

[21] Appl. No.: 63,089

[22] Filed: May 18, 1993

[51] Int. Cl.[5] ..... F24F 7/02

[52] U.S. Cl. ..... 454/260; 52/95

[58] Field of Search ..... 52/60, 95, 96; 454/260, 454/365

[56] References Cited

U.S. PATENT DOCUMENTS

| | | | |
|---|---|---|---|
| 2,954,727 | 10/1960 | Katt et al. | 454/260 |
| 2,969,726 | 1/1961 | Bottom | 454/260 |
| 3,073,235 | 1/1963 | Smith et al. | 454/260 X |
| 3,683,785 | 8/1972 | Grange | 454/360 |
| 3,777,649 | 12/1973 | Luckey | 454/260 |
| 4,126,973 | 11/1978 | Luckey | 454/260 X |
| 4,347,691 | 9/1982 | Lloyd-Jones | 52/95 |
| 4,607,566 | 8/1986 | Bottomore et al. | 454/260 |
| 4,643,080 | 2/1987 | Trostle et al. | 454/365 |
| 4,660,463 | 4/1987 | Bottomore et al. | 454/260 |
| 4,964,248 | 10/1990 | Braine et al. | 52/96 X |
| 4,995,308 | 2/1991 | Waggoner | 454/260 |

FOREIGN PATENT DOCUMENTS

| | | | |
|---|---|---|---|
| 73980 | 12/1916 | Switzerland | 52/95 |

*Primary Examiner*—Harold Joyce

*Attorney, Agent, or Firm*—Charles W. Chandler

[57] ABSTRACT

A fascia ventilator has a polyvinyl chloride extruded, unitary panel having an upper panel section adapted to be attached to a roof-covering support member, an intermediate section forming a drip edge, and a lower section supported parallel to the fascia board. In one version, the baffle is mounted between the lower panel section and the fascia board. In another version the lower edge of the panel is perforated and bent to form a baffle for receiving air passing between the ventilator and the fascia board. The ends of adjacent ventilator panels may be joined in an end-to-end overlapping connection.

12 Claims, 3 Drawing Sheets

FASCIA VENTILATOR AND DRIP EDGE

BACKGROUND OF THE INVENTION

Fascia ventilators are mounted beneath the overhang of a roof for guiding air flow through an opening between the roof and the fascia board. U.S. Pat. No. 4,607,566 which was issued to David Bottomore and Colin F. Gibson on Aug. 26, 1986 for "Ventilator for Use in a Roof Structure" illustrates an example of such a ventilator. Similar devices are illustrated in U.S. Pat. No. 4,660,463 which was issued Apr. 29, 1987 to David Bottomore for a "Roof Space Ventilator"; U.S. Pat. No. 3,683,785 which issued Aug. 15, 1972 to Howard L Grange for a "Roof Construction Providing Air Flow from Eave to Ridge"; U.S. Pat. No. 2,954,727 which was issued Oct. 4, 1960 to Harold M. Katt and James M. Simmons; and U.S. Pat. No. 4,995,308 which was issued Feb. 26, 1991 to Richard L. Waggoner for "Roof Ventilating Apparatus".

SUMMARY OF THE INVENTION

The broad purpose of the present invention is to provide an improved fascia ventilator which may be readily mounted between a roof covering support panel and the fascia board.

The preferred embodiment of the invention comprises a 3-part structure. One part comprises an elongated, extruded, polyvinyl chloride panel having an upper section mounted on the roof support structure beneath the shingles. The upper section extends down about 1-½" beyond the fascia board, is bent toward the fascia board to form a drip edge, and then extends downwardly 4 inches, parallel to the fascia board. A pair of vertically spaced, horizontal lips on the inner face of the lower section receive a perforated baffle. The baffle and the lower panel section are nailed to the fascia board, to guide air flow upwardly toward an opening between the fascia board and the roof into the interior of the roof. Two baffles, mounted end-to-end, are carried on the lips of each panel.

The vertical edge of the panel end has a slot. The lower baffle-receiving lip below the slot is trimmed about 1" from the end edge in such a manner that a pair of panels may be joined together end-to-end by slipping one of the panels into the slot of the other panel. The overlapping panels form a substantially continuous surface along the fascia board.

The panel can be used without the baffle as a drip edge, for commercial roofing.

Another embodiment of the invention has a panel with an integral perforated baffle.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
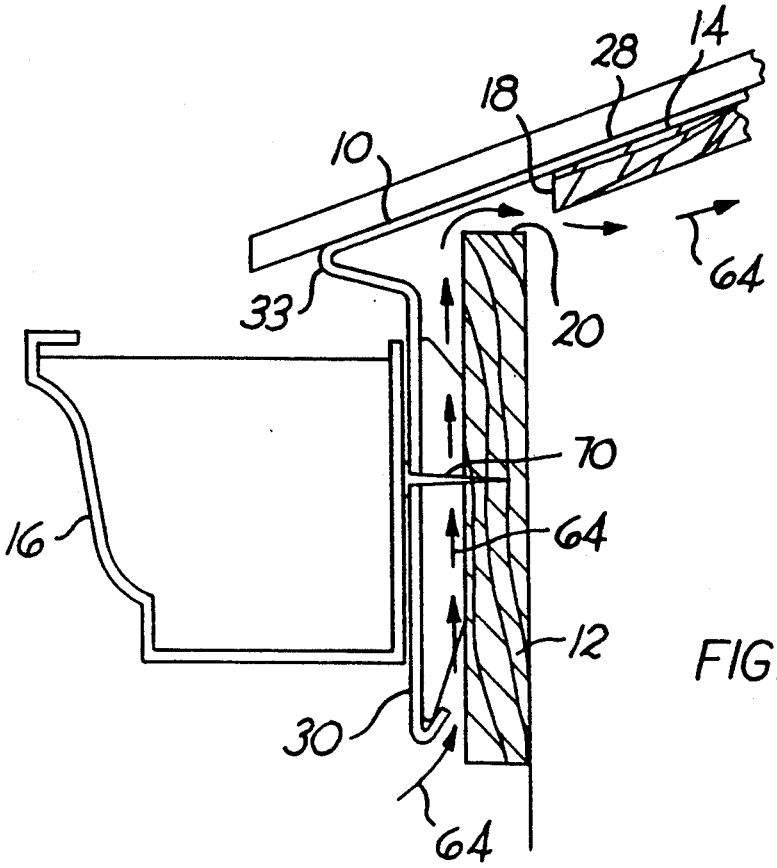
FIG. 1 shows a fascia ventilator illustrating the preferred embodiment of the invention mounted between a fascia board and a building gutter.

Referring to the drawings, a preferred fascia ventilator 10 is illustrated in FIG. 1 mounted on fascia board 12 and roof covering support 14. Ventilator 10 is elongated, running several feet parallel to the length of fascia board 12 and behind a conventional gutter 16. The lower edge of roof covering support 14 is trimmed at 18 to form an opening 20 between the upper edge of the fascia board and the roof support. Ventilator 10 guides air through opening 20 into the interior of the roof.

Figure 5:
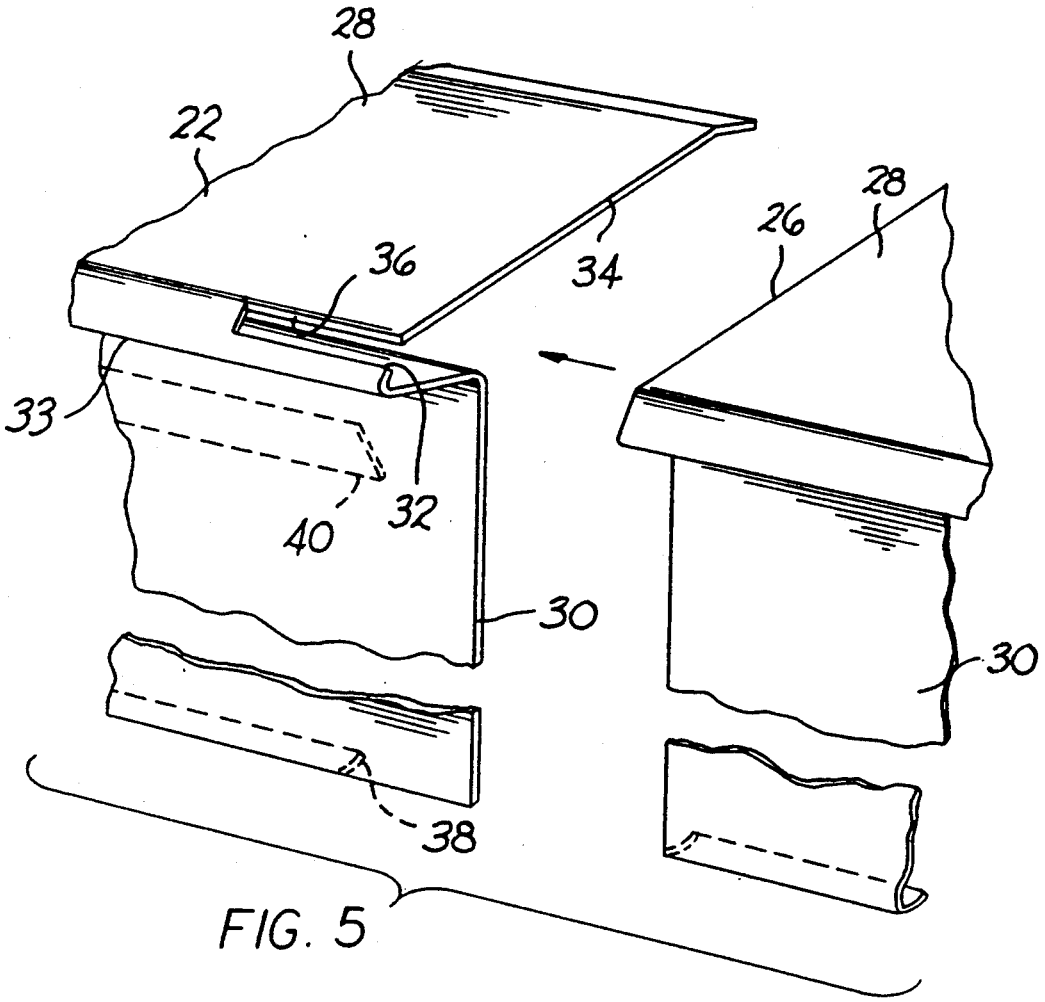
FIG. 5 is a view illustrating a pair of the ventilator panels prior to being joined together end-to-end, with the baffle removed.

The fascia ventilator is formed of three components, a panel 22, illustrated in FIG. 5, and a pair of end-to-end baffles. A second ventilator 26, shown in FIG. 5, has a panel with an identical cross section to that of panel 22, including a pair of baffles (not shown).

Panel 22 preferably has a length of 61 inches, includes an upper, generally planar panel section 28 disposed parallel to roof covering support 14, and a lower panel section 30 disposed in a vertical position parallel to the outer surface of the fascia board.

Referring to FIG. 5, upper panel section 28 has a width of about 5 inches. The lower edge of the upper panel section is bent with a generally "U" shaped bight 32 to form an outside drip edge 33. The lower section of the drip edge is bent in a reverse direction about an 1" and then bent downwardly to form lower panel section 30. Bight 32 is somewhat resilient, like a hinge, so that the angle between the upper panel section and the lower panel section may be adjusted to accommodate the angle between the roof support structure and the fascia board.

Panel 22 has a linear end edge 34. A 1" slot 36 extends inwardly from end edge 34 and generally at right angles with respect to the end edge, through bight 32. The lower edge of panel section 30 is bent upwardly to form a lip 38 which extends at about a 60 degree angle from the back surface of the lower panel section. Lip 38 extends along the full length of the panel except for a 1" bottom cut-out portion extending from end edge 34.

An upper lip 40, about 3.6" above the lower lip, is bent down to form about a 60 degree angle with respect to the back side of the lower panel section. The upper lip also runs the full length of panel 10, except for a 1" cut-out portion adjacent end edge 34.

Figure 2:
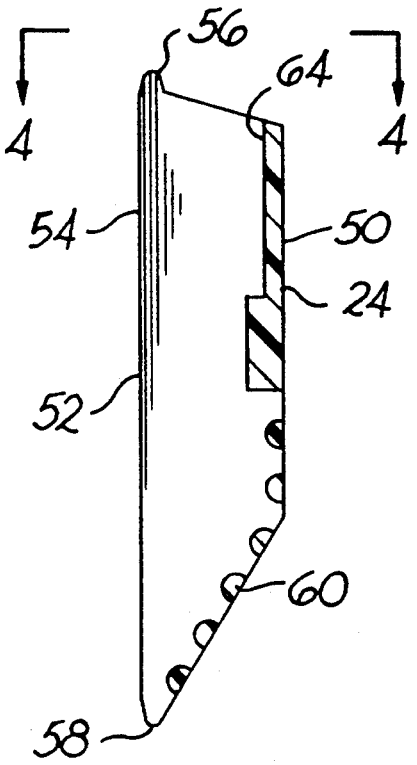
FIG. 2 is an enlarged sectional view of a preferred baffle mounted between the lower panel of the ventilator and the fascia board.
Figure 3:
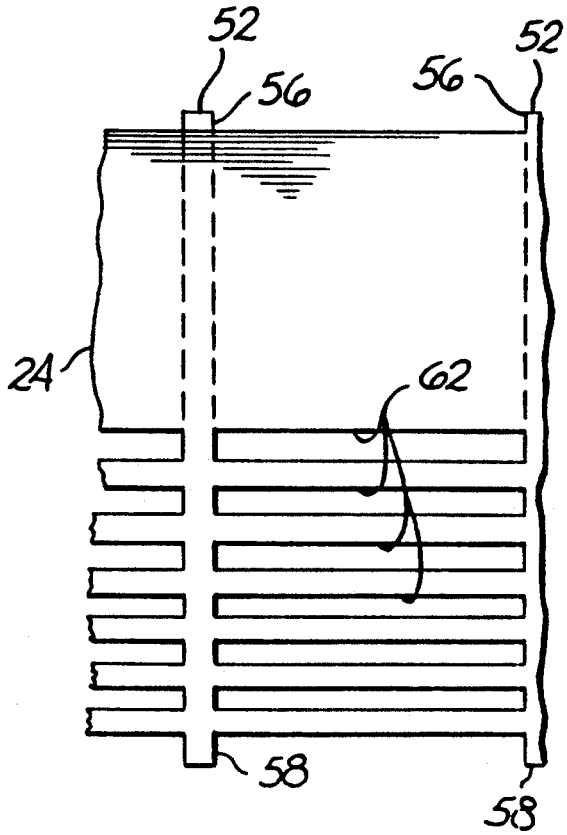
FIG. 3 is a view substantially as seen along the right side of FIG. 2.
Figure 4:
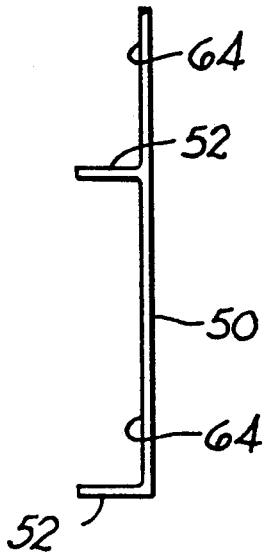
FIG. 4 is a view as seen along lines 4—4 of FIG. 2.

Referring to FIGS. 2 and 3, baffle 24 comprises an elongated cover member 50, 30 inches long. Cover member 50 is mounted on a series of integral, horizontally-spaced, parallel walls 52. Walls 52 are disposed transverse to the longitudinal axis of cover member 50, about 2" apart. Each wall 52 has a linear edge 54 disposed adjacent the inside surface of lower panel section 30. Upper toe 56 and lower toe 58 extend from opposite ends of edge 54. Upper toe 56 is snapped under lip 40 while lower toe 58 is snapped inside lip 38 to trap the baffle between the two lips.

Cover member 50 has a body parallel to edge 52, and a lower section 60 formed with a plurality of openings 62 that are parallel to the longitudinal axis of the baffle. Openings 62 pass air upwardly through the baffle in the direction of arrows 64, as illustrated in FIG. 1. The upper edge of cover member 50 forms an opening 64 between each pair of walls 52, and lower panel section 30.

When the ventilator is mounted in place, nail means 70 attach the ventilator to the outside surface of the fascia board. The drip edge is disposed 1 inch inside the lower edge of roof support 14.

Figure 6:
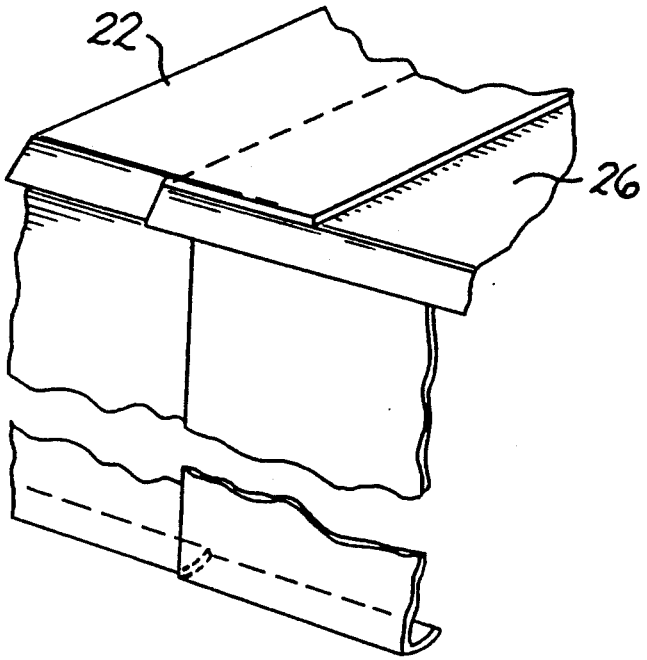
FIG. 6 is a view illustrating the two ventilator sections joined in an overlapping relationship.

FIGS. 5 and 6 show ventilator 10 joined end-to-end with ventilator 26. The end of the panel of ventilator 26 is mated in an overlapping relationship with panel 22 by slipping the bight of the panel of ventilator 26 into slot 36. In this position, the upper panel section of ventilator 26 is disposed under the upper panel section 32 of ventilator 10. The lower panel section of ventilator 26 overlaps the outside surface and end edge of panel 22, as illustrated in FIG. 6. The two panels are joined together by pushing one panel toward the other until the end of the lower panel section of ventilator 26 abuts the closed end of slot 36. The lower lip of ventilator 26 wraps around the lower edge of ventilator 10, and abuts the end of lower lip 38. Ventilator 26 is then nailed to the fascia board in the same manner as ventilator 10.

Figure 7:
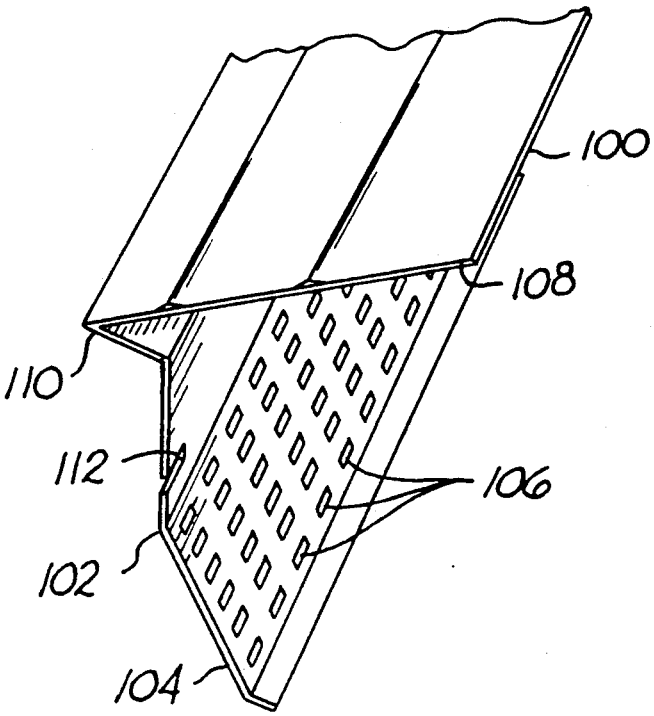
FIG. 7 is a perspective view of a ventilator panel illustrating another embodiment of the invention.

FIG. 7 illustrates a panel 100 which is identical to ventilator 10 except that it does not have the upper and lower baffle retaining lips. Instead panel 100 has the mid section of its lower panel section bent away from the drip edge along a fold line 102 to form an integral baffle wall 104 that spans the distance between the panel and the fascia board. Baffle wall 104 has six rows of $3/16'' \times \frac{1}{2}''$ breather slot means 106 permitting air to pass upwardly between the ventilator panel wall and the fascia board.

This embodiment of the invention has an upper panel section 108 disposed beneath the roof support, a drip edge 110 and a slot 112 in the end of the panel. This panel is also connected end-to-end with an adjacent ventilator in the same manner as the embodiment illustrated in FIGS. 5 and 6.

Figure 8:
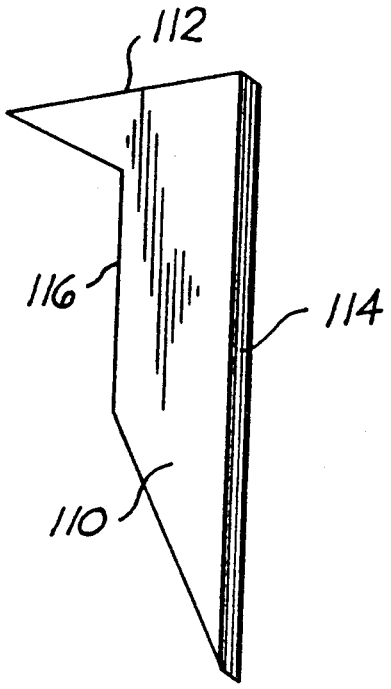
FIG. 8 illustrates a typical stiffening wall attached inside the panel of FIG. 7.

FIG. 8 illustrates a typical stiffening wall 110 used with panel 100. Stiffening wall 110 has a top edge 112 attached to the underside of upper panel section 108. Rear edge 114 engages the facia board, and a front edge 116 is attached to the inside of wall 104. Wall 112 is attached to the inside of panel 100 in regularly-spaced intervals to support the panel. Further, wall 110 is supported in a vertical position at right angles to the facia board breather to guide air upwardly between adjacent stiffening walls through breather slot means 106.

Having described our invention, we claim:

1. A two-piece facia ventilator for a building having a vertical wall structure, an inclined roof structure extending outwardly from the wall structure, and an opening beneath the roof structure and above the vertical wall structure, the ventilator comprising:

an elongated one-piece planar outer panel including an elongated upper panel section for disposition on the inclined roof structure, a planar lower section suited for attachment to the vertical wall structure in a horizontally-spaced position, and a bend connecting the upper panel section to the lower panel section, the lower panel section having a lower edge;

lip structure integrally carried on the lower panel section;

a baffle member having means engageable with the lip structure for retaining the baffle member on the lower panel section between the lower panel section and the vertical wall structure, the baffle member having a pair of spaced baffle walls extending parallel to the lower panel section and providing passage means for directing air flow upwardly from the lower edge of the lower panel section, and including structure between said parallel baffle walls for retaining the lower panel section in a spaced position with respect to the vertical wall;

whereby, air can pass upwardly between the lower panel section and the vertical wall structure toward the opening above the vertical wall structure.

2. A facia ventilator as defined in claim 1, in which the lip structure includes a horizontal upper lip and a horizontal lower lip, the baffle member having structure engageable with the upper lip and the lower lip for connecting the baffle member to the lower panel section.

3. A facia ventilator as defined in claim 2, in which the pair of baffle walls are elongated, one of the pair of baffle walls having perforations therein for permitting the passage of air, and said structure between the parallel baffle walls being a plurality of spaced parallel elongated vertical walls disposed at right angles to the baffle wall, the vertical walls having a sufficient thickness to support the lower panel section against motion as it is being nailed to the vertical wall structure.

4. A facia ventilator as defined in claim 1, in which the upper panel section is disposed on opposite sides of a plane containing the lower panel section, the lower panel section having an outer side facing a gutter, and an inner side facing the vertical wall structure, and the upper panel section having a lower edge bent in a generally U-shaped bight to form an outside drip edge to prevent water from dripping on the lower panel section from the roof structure.

5. A facia ventilator as defined in claim 1, in which the bend connecting the upper panel section and the lower panel section is resilient to adjust the angle of the plane of the upper panel section to the plane of the lower panel section.

6. A facia ventilator as defined in claim 1, including nail fastener means for fastening the lower panel section to the vertical wall structure.

7. A facia ventilator as defined in claim 1, in which the outer panel is formed of a plastic extrusion.

8. A facia ventilator as defined in claim 1, in which the outer panel is formed of a rigid polyvinyl chloride material.

9. A facia ventilator as defined in claim 1, in which the outer panel is elongated with generally vertical ends, and at least one end has slot means for engaging the end of an adjacent outer panel in an end-to-end relationship.

10. A facia ventilator as defined in claim 1, in which the upper panel section has a lower edge bent toward the lower panel section to form a drip edge for water passing down the roof structure to prevent such water from dripping on the lower panel section and the vertical wall structure.

11. A facia ventilator as defined in claim 2, in which the lower edge of the lower panel section is bent to form said lower lip.

12. A two-piece facia ventilator for a building having a vertical wall structure, and an inclined roof structure extending outwardly from the wall structure, the ventilator comprising:

an elongated one-piece planar outer panel including an upper elongated panel section for disposition on the inclined roof structure, a planar lower panel section adapted to be connected to the vertical wall structure in a horizontally-spaced position, and a bend connecting the upper panel section to the lower panel section, the lower panel section having a lower edge;

a pair of vertically spaced, parallel, integral lips disposed on the lower panel section and below the upper panel section;

a baffle member having means engageable with the pair of lips so as to be retained on the lower panel section, the baffle member having passage means for directing air flow upwardly from the lower edge of the lower panel section, the baffle member having integral spaced wall structure disposed at right angles to the lower panel section and between the lower panel section, and the vertical wall structure to prevent movement of the lower panel section toward the wall structure as the outer panel is being nailed to the vertical wall structure for retaining the lower panel section in a spaced position with respect to the vertical wall structure;

whereby, air can pass upwardly between the lower panel section and the vertical wall structure.

* * * * *